US007126555B2

(12) United States Patent
Huang

(10) Patent No.: US 7,126,555 B2
(45) Date of Patent: Oct. 24, 2006

(54) DIPOLE ANTENNA

(75) Inventor: Wen-Man Huang, Hsinchu (TW)

(73) Assignee: Z-Com, Inc., Hsinchu (TW)

( * ) Notice: Subject to any disclaimer, the term of this patent is extended or adjusted under 35 U.S.C. 154(b) by 10 days.

(21) Appl. No.: 11/033,557

(22) Filed: Jan. 12, 2005

(65) Prior Publication Data

US 2006/0152428 A1 Jul. 13, 2006

(51) Int. Cl.
*H01Q 9/28* (2006.01)

(52) U.S. Cl. ..... 343/795; 343/702

(58) Field of Classification Search ..... 343/795, 343/742, 702, 846, 860, 864
See application file for complete search history.

(56) References Cited

U.S. PATENT DOCUMENTS 5,754,145 A 5/1998 Evans ..... 343/795
6,344,823 B1 * 2/2002 Deng ..... 343/846
6,456,246 B1 * 9/2002 Saito ..... 343/702
6,650,301 B1 * 11/2003 Zimmerman ..... 343/795
6,864,854 B1 * 3/2005 Dai et al. ..... 343/702

* cited by examiner

*Primary Examiner*—Hoang V. Nguyen
*Assistant Examiner*—Ephrem Alemu
(74) *Attorney, Agent, or Firm*—Rabin & Berdo, P.C.

(57) ABSTRACT

A dipole antenna is provided. A radiation portion receives radio signals. A first matching portion includes a body section with one terminal connecting to the radiation portion, and a feed section connecting to another terminal of the body section. A second matching portion has one terminal connecting to the radiation portion to brace the radiation portion with the first matching portion in a cooperative manner. A ground portion connects to another terminal of the second matching portion. The radiation portion has an electric length of a half of a wavelength. The two matching portions have an electric length of a quarter of a wavelength. The radiation portion and the matching portions may be formed in an integrated manner.

18 Claims, 8 Drawing Sheets

DIPOLE ANTENNA

BACKGROUND OF THE INVENTION

1. Field of the Invention

The present invention relates to an antenna, and more particularly to a dipole antenna being an antenna of one wavelength of electricity having a radiation portion with an electric length of a half of a wavelength and two matching portions respectively with an electric length of a quarter of a wavelength for receiving or transmitting radio signals.

2. Description of the Related Art

With advances of technology nowadays, people can transmit information through a wireless transmission system without restriction. The antenna is an important element in the wireless transmission system. It generally is located in a wireless transmission device (such as a base station, wireless network card, bridge, router, or handset) to transform the voltage and current of a transmitter to radio signals, and broadcast the radio signals in the air by radiation. It also can receive and transform the radio signals to voltage and current to be processed in a receiver. In the prevailing trend that demands 'slim' and 'light' for wireless transmission devices, the conventional antenna is out of date. How to shrink the antenna and maintain the antenna function has become an important issue in research and development.

The commonly used dipole antenna mostly is formed in a cylindrical manner with a stripped coaxial cable housed and soldered in a metallic barrel. The copper conductive wire of the coaxial cable is connected to a transmission circuit of a circuit board in a wireless transmission device. The metallic mesh of the coaxial cable is connected to the barrel and the ground terminal of the circuit board. Its structure is generally like the one shown in FIG. 1. It includes a conductive wire 110, a ground layer 120 and a metallic duct 130. An insulation layer 112 covers the conductive wire 110. The ground layer 120 surrounds or covers the outer side of a lower terminal of the conductive wire 110 and is covered by another insulation layer 122. The metallic duct 130 is located on an upper terminal of the ground layer 120 and has an upper terminal connecting to the top terminal of the ground layer 120.

While the construction set forth above has substantially shrunk the length and size of the conventional antenna, its cylindrical shape is difficult to be installed on the wireless transmission device. Hence it usually needs a ground terminal on a distal terminal of the antenna body, to be installed securely on the wireless transmission device. Moreover, such an antenna often is extended outside the installed wireless transmission device. It is prone to be hit and damaged during transportation or use.

Refer to FIGS. 2 and 3 for a printed antenna disclosed in U.S. Pat. No. 5,754,145. It includes a dielectric substrate 200, a first element 210, two second elements 220 and 230 and a ground portion 240.

The first element 210 is located on one side of a dielectric substrate 200 and is an elongate and dipolar conductive strip. The first element 210 has a radiation portion 212 on one terminal and a feed portion 214 on other end. The second elements 220 and 230 are located on two sides of the axis of the first element 210 and have one terminal connecting to the ground portion 240 on a location about one quarter of a wavelength from the radiation terminal of the first element 210. The two second elements 220 and 230 are conductive strips at a length of one quarter of a wavelength. The ground portion 240 is located on another side of the dielectric substrate 200 opposite to the first element 210, and is also a conductive strip, which has one terminal connecting to the feed portion 214.

The printed antenna mentioned above is directly formed on a circuit board of a desired wireless transmission device in the fabrication process of the printed circuit board. While the finished wireless transmission device does not need to add an extra antenna, the fabrication cost is higher. There is still a need for a low cost antenna that is easy to install and provides required functions.

SUMMARY OF THE INVENTION

Accordingly, the invention is directed to a dipole antenna thereof that substantially obviates one or more of the problems due to limitations and disadvantages of the related art.

The dipole antenna according to the invention is made of a metal sheet that has a conductive effect and may be installed securely on a wireless transmission device.

In one aspect, the dipole antenna according to the invention has two matching portions to brace a radiation portion, which is spaced from a ground portion at a distance, to form a stereoscopic structure to shrink the total size of the antenna.

In another aspect, the radiation portion of the dipole antenna according to the invention has an electric length of a half of a wavelength, and the two matching portions have an electric length of a quarter of a wavelength.

In yet another aspect, the dipole antenna of the invention may be made of metal in an integrated manner.

To achieve these and other advantages and in accordance with the purpose of the present invention, as embodied and broadly described, the dipole antenna including: a radiation portion, a first matching portion, a second matching portion and a ground portion. The radiation portion receives radio signals. The first matching portion includes a body section and a feed section. One terminal of the body section connects to the radiation portion and another terminal connects to the feed section. One terminal of the second matching portion connects to the radiation portion and another terminal connects to the ground portion. The first and second matching portions brace the radiation portion.

The radiation portion has an electric length of a half of a wavelength and the two matching portions have respectively an electric length of a quarter of a wavelength.

The radiation portion, first and second matching portions and ground portion are made of a thin sheet of conductive metal in an integrated manner.

The orientation of the feed section is substantially in parallel with the orientation of the ground portion. The feed section is spaced from the ground portion at a determined distance to generate a capacity effect. The determined distance is depended on the capacity to be demanded. If a region of the ground portion opposite to the feed section is a gap that is slightly larger than the feed section, the feed section and the ground portion may be located on the same plane.

In yet another aspect, one terminal of a conductive wire is soldered through the juncture of the body section and the feed section and another terminal connects to a transmission circuit of the wireless transmission device. In addition, the conductive wire may be a coaxial cable to transmit signals between the antenna and the wireless transmission device. When a coaxial cable is used, a small section of one terminal of the coaxial cable is stripped its outer layer and two terminals of the small section are respectively soldered through the juncture and on the ground portion to generate an inductance effect so as to improve the performance of the antenna.

In this case, the dipole antenna of the invention further includes an anchor section connecting to the ground portion for installing the antenna. An included angle between the anchor section and the ground portion is about 90 degrees. Moreover, the anchor section, the radiation portion, first matching portion, second matching portion and ground portion may also be made of metal in an integrated manner.

BRIEF DESCRIPTION OF THE DRAWINGS

The invention will become more fully understood from the detailed description given herein below illustration only, and thus are not limitative of the present invention, and wherein.

DESCRIPTION OF THE PREFERRED EMBODIMENTS

Figure 1:
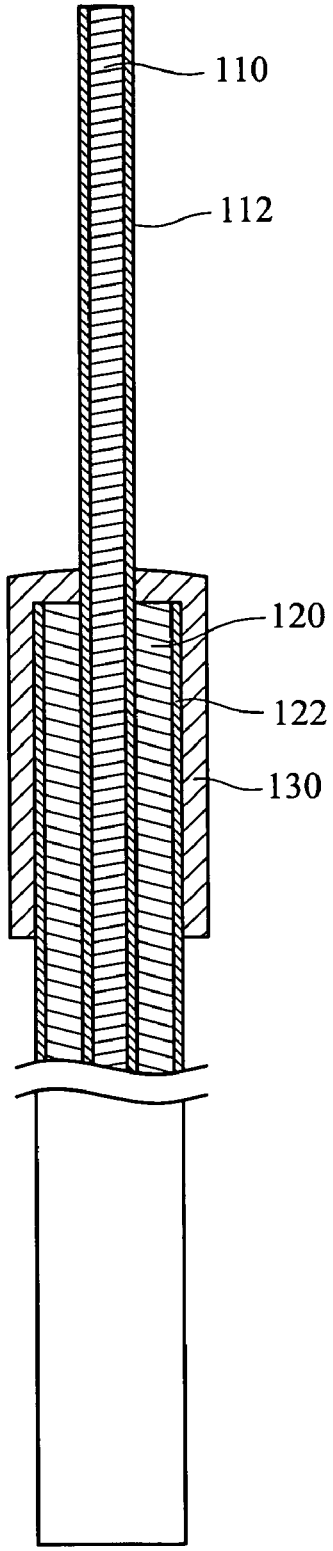
FIG.1 (PRIOR ART)
FIG. 1 is a schematically structural drawing showing a conventional dipole antenna.
Figure 2:
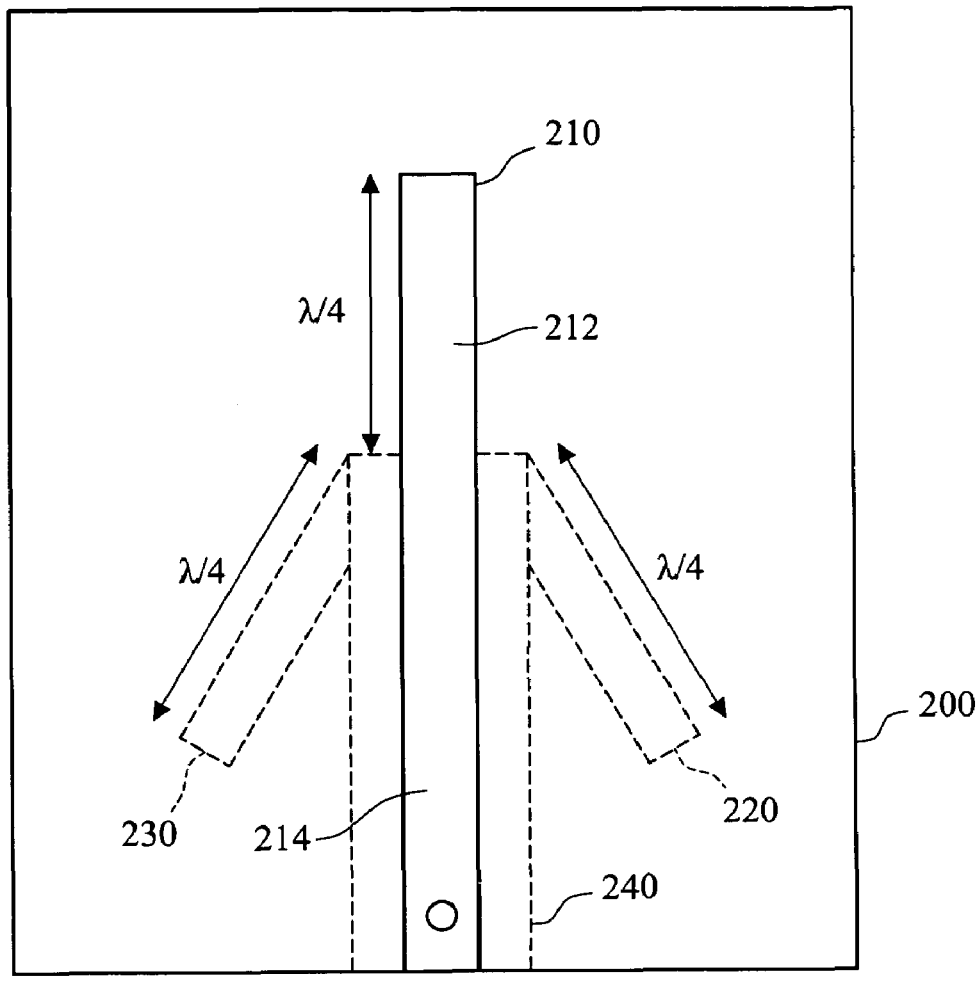
FIG.2 (PRIOR ART)
FIG. 2 is a schematic drawing showing a top view of a conventional printed circuit board containing a dipole antenna.
Figure 3:
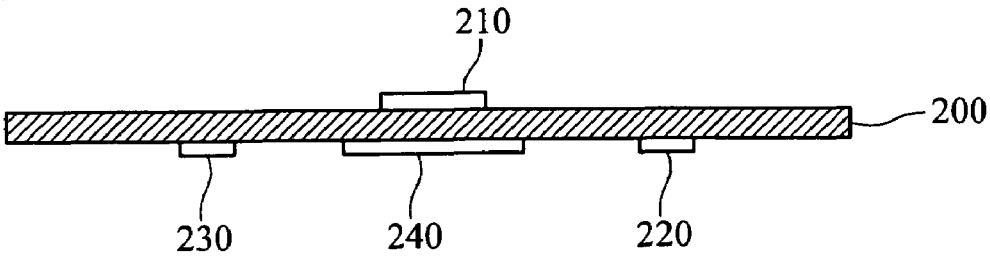
FIG.3 (PRIOR ART)
FIG. 3 is a schematic drawing showing a side view of a conventional printed circuit board containing a dipole antenna.
Figure 4A:
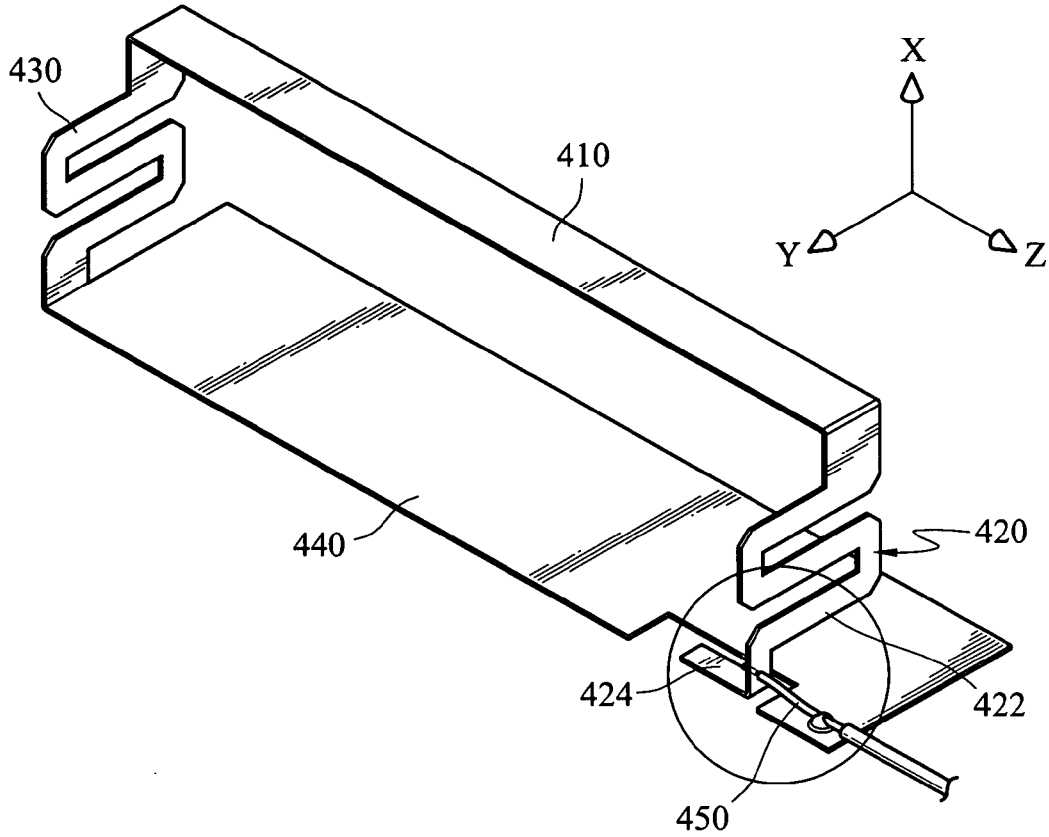
FIG. 4A is a schematically structural drawing showing a dipole antenna according to an embodiment of the invention.

With reference to FIG. 4A, the dipole antenna according to an embodiment of the invention includes a radiation portion 410, a first matching portion 420, a second matching portion 430 and a ground portion 440. The radiation portion 410 receives radio signals. The first matching portion 420 includes a body section 422 and a feed section 424. One terminal of the body section 422 connects to one terminal of the radiation portion 410, and another terminal of the body section 422 connects to the feed section 424. One terminal of the second matching portion 430 connects to another terminal of the radiation portion 410, and another terminal of the second matching portion 430 connects to one terminal of the ground section 440. The first and second matching portions 420, 430 brace the radiation portion 410.

The ground portion 440 may be securely mounted onto a wireless transmission device through a bonding means, such as a double-sided adhesive tape, Velcro strips or the like.

The radiation portion 410 has an electric length of a half of a wavelength and the first and second matching portions 420 and 430 have respectively an electric length of a quarter of a wavelength to generate a matching impedance with the radiation portion 410.

The radiation portion 410, first and second matching portions 420 and 430, and ground portion 440 are made of a thin sheet of conductive metal, such as nickel,copper or the like. The dipole antenna may also be formed in an integrated manner. Namely, the aforesaid four portions 410, 420, 430 and 440 may be fabricated from one thin metal sheet to form the dipole antenna.

The radiation portion 410 and the ground portion 440 are substantially rectangular. The two matching portions 420 and 430 are formed in the wandering shape to shorten the distance between the radiation portion 410 and the ground portion 440. Moreover, besides the substantial rectangle, the radiation portion 410 and ground portion 440 may also be formed in other geometric shapes. The two matching portions 420 and 430, besides the zigzag shape, may also be formed in other geometric shapes.

The two matching portions 420 and 430 are formed in a direction substantially normal to the direction of the radiation portion 410, and also substantially normal to the direction of the ground portion 440. Thus, the radiation portion 410 and the ground portion 440 are substantially parallel with each other. The feed section 424 of the first matching portion 420 is substantially normal to the first matching portion 420. When the radiation portion 410 and the ground portion 440 are substantially parallel with each other, the feed section 424 also is substantially parallel with the ground portion 440. Hence, the ground portion 440 and the feed section 424 are spaced from each other at a determined distance; thereby a capacity effect is generated. Moreover, a notch is formed in a region of the ground portion 440 opposite to the feed section 424, that is slightly larger than the feed section 424, so as to define a gap between the feed section and the ground portion. Then the feed section 424 and the ground portion 440 may be located on the same plane.

Figure 4B:
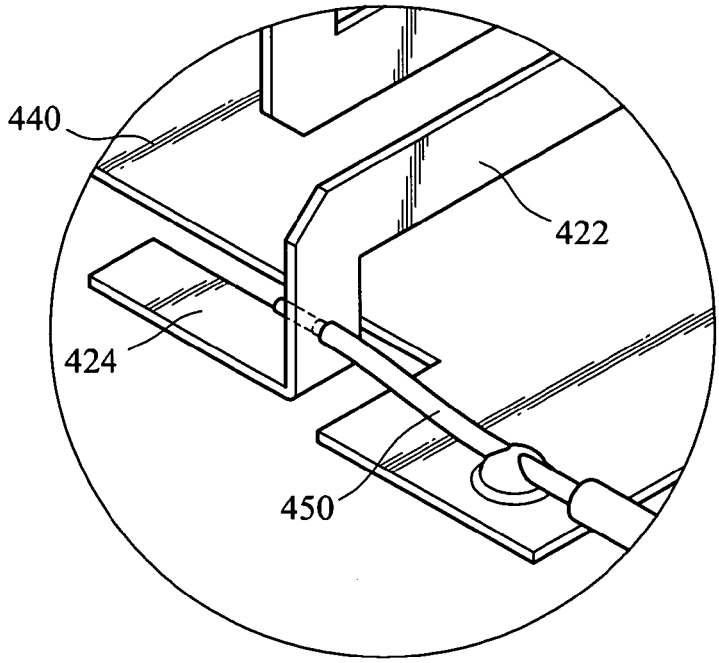
FIG. 4B is a schematic drawing showing a enlarging view of a first matching portion soldered on a coaxial cable in FIG. 4A.

The body section 422 and the feed section 424 are connected on a juncture, which may be run through by one terminal of a conductive wire that is anchored by soldering. The conductive wire has another terminal connecting to a transmission circuit of a wireless transmission device. In addition, a coaxial cable 450 may be used to transmit signals between the antenna and the wireless transmission device. When the coaxial cable 450 is used, the outer layer of a small section of one terminal thereof can be stripped to expose the metal mesh. One terminal of the small section without the outer layer is soldered through the juncture of the body section 422 and the feed section 424, and another terminal thereof is soldered on the ground portion 440, so as to form an induction effect to enhance antenna performance as shown in FIG. 4B.

Figure 5:
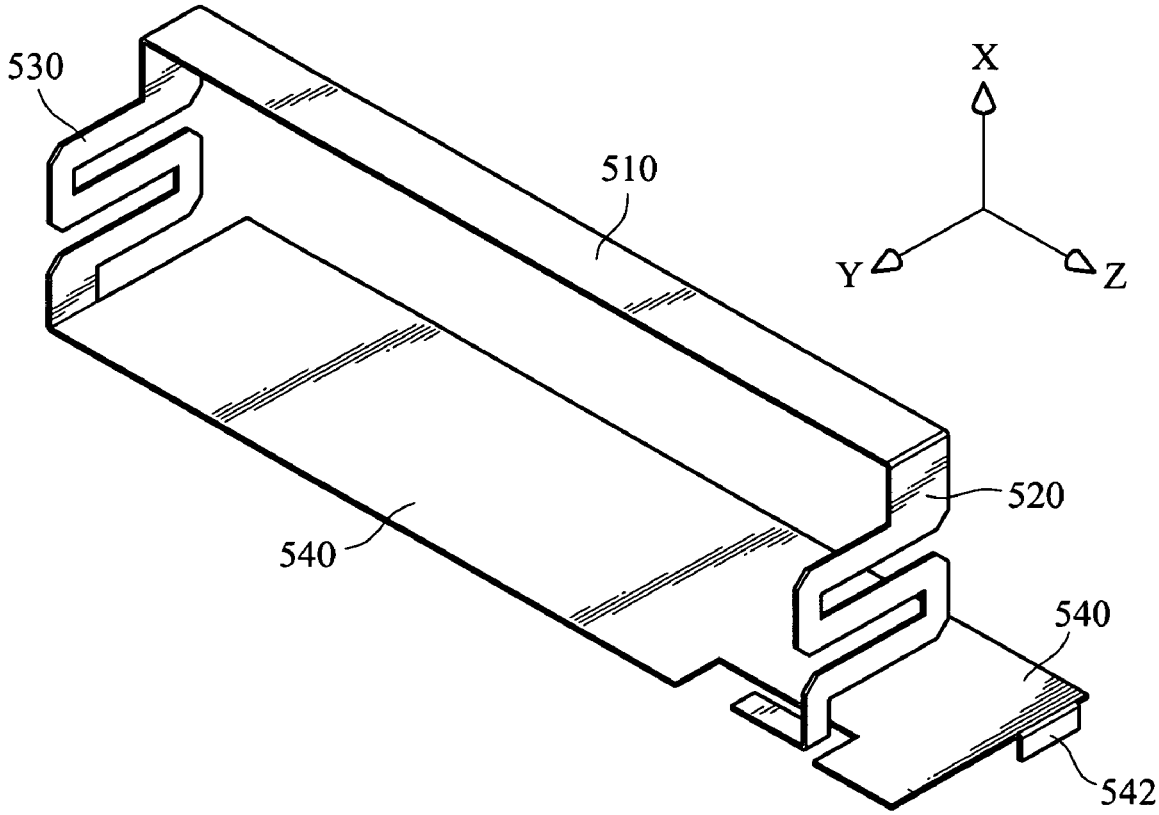
FIG. 5 is a schematically structural drawing showing a dipole antenna according to another embodiment of the invention.

Refer to FIG. 5 for another embodiment of the dipole antenna of the invention. It includes a radiation portion 510, a first matching portion 520, a second matching portion 530 and a ground portion 540. The radiation portion 510, first matching portion 520, second matching portion 530 and ground portion 540 are constructed substantially the same as the radiation portion 410, first matching portion 420, a second matching portion 430 and ground portion 440 shown in FIG. 4A, hence details are omitted.

However, in this embodiment the ground portion 540 has an anchor section 542 substantially normal to the ground portion 540. When the ground portion 540 is mounted onto a wireless transmission device by a bonding means, the anchor section 542 may be wedged in a slit of a wireless transmission device to anchor the dipole antenna more securely on a selected location of the wireless transmission device. The anchor section 542 may be formed in a rectangle or other geometric shape.

Figure 6:
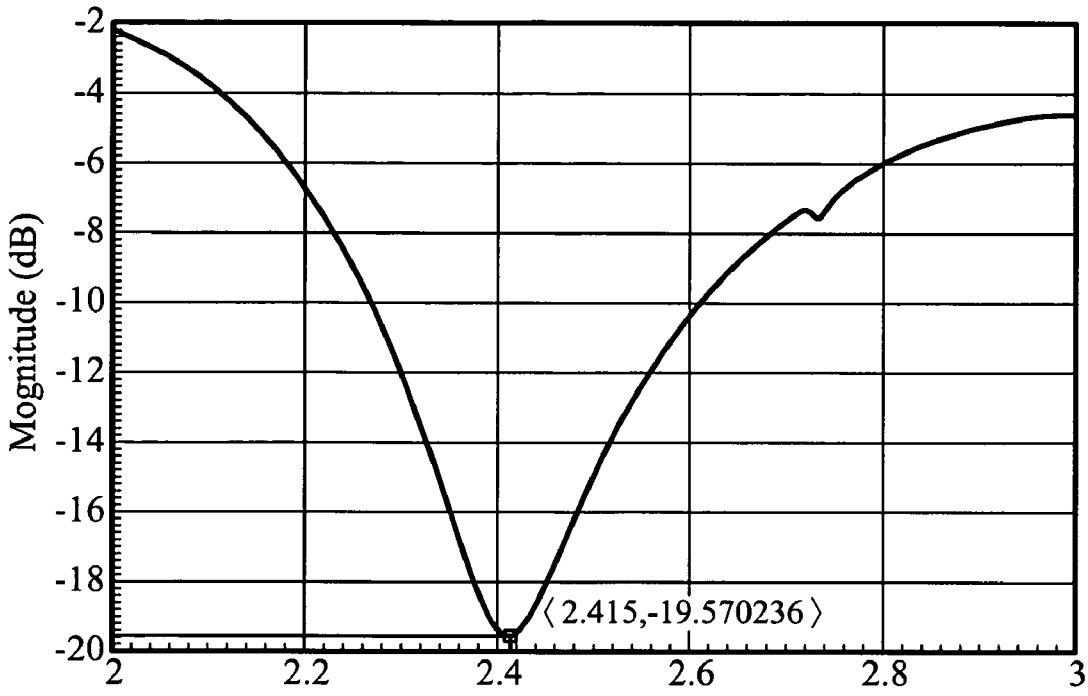
FIG. 6 is a chart showing the experimental measurement of return loss of the dipole antenna according to the embodiment of the invention.
Figure 7:
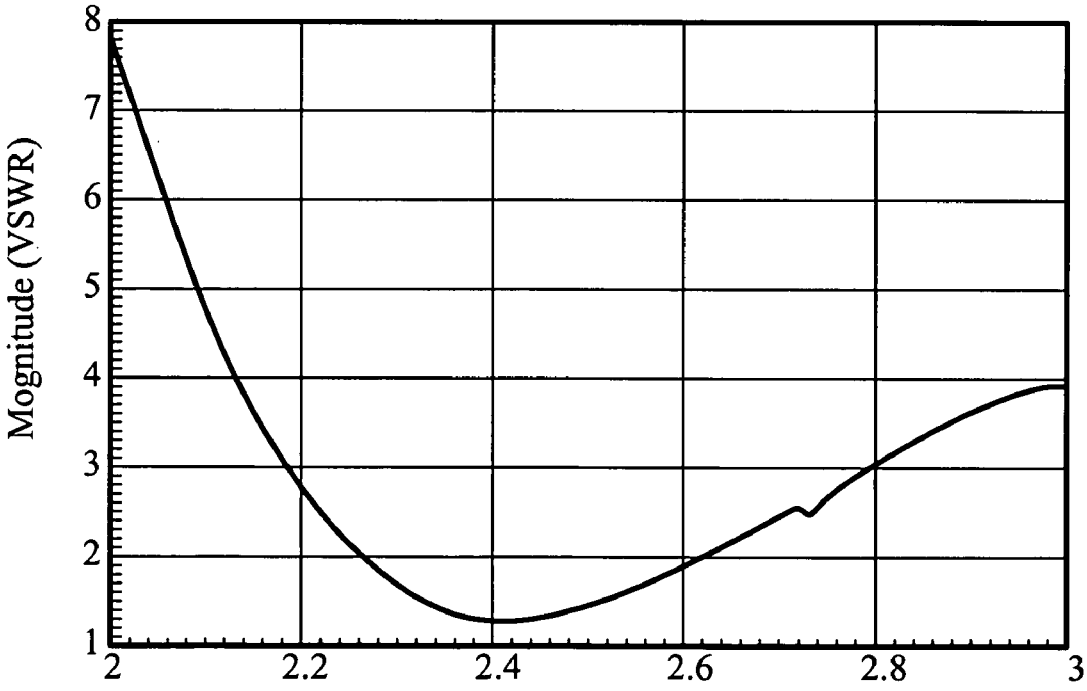
FIG. 7 is a chart showing the experimental measurement of voltage stationary wave ratio of the dipole antenna according to the embodiment of the invention.
Figure 8:
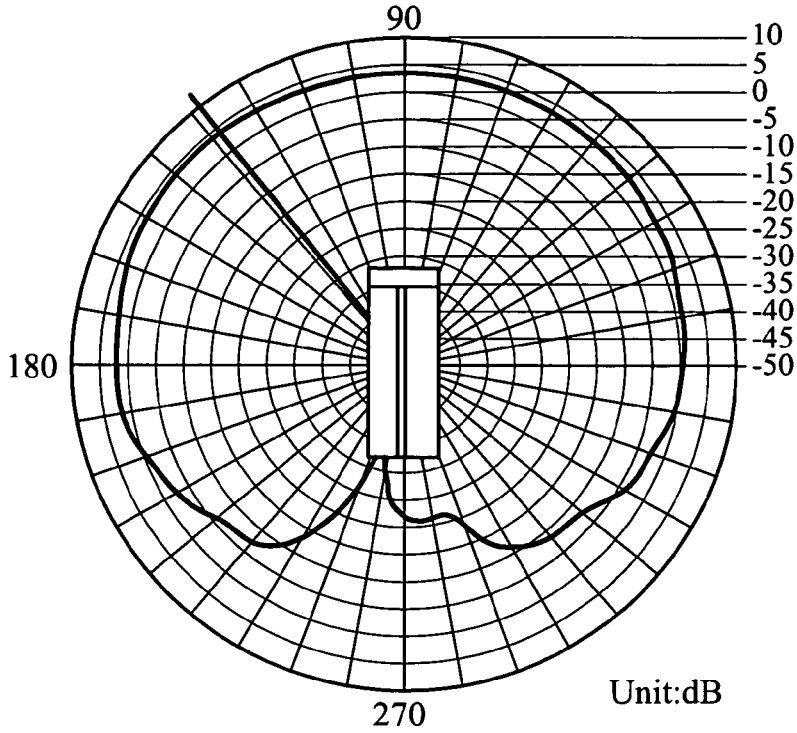
FIG. 8 is a chart showing the experimental measurement of the radiation field profile on the x-y plane when the dipole antenna according to the embodiment of the invention is applied to 2.4 GHz.
Figure 9:
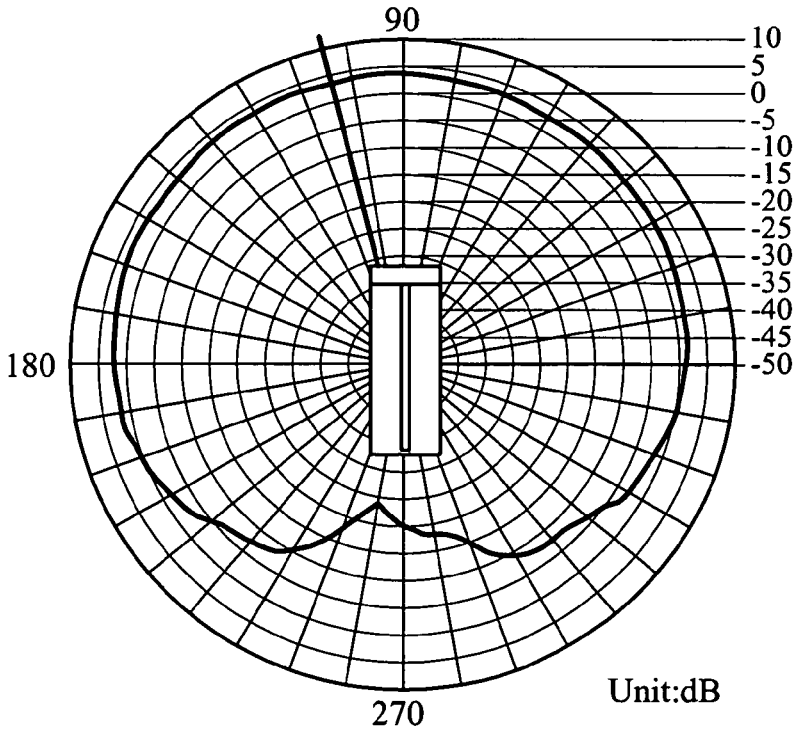
FIG. 9 is a chart showing the experimental measurement of the radiation field profile on the x-y plane when the dipole antenna according to the embodiment of the invention is applied to 2.45 GHz.
Figure 10:
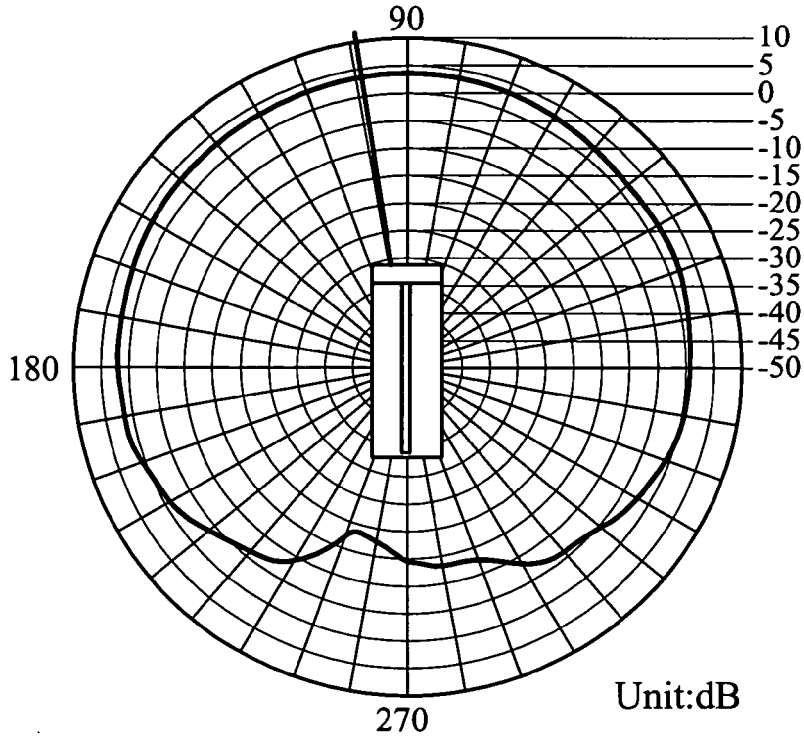
FIG. 10 is a chart showing the experimental measurement of the radiation field profile on the x-y plane when the dipole antenna according to the embodiment of the invention is applied to 2.5 GHz.
Figure 11:
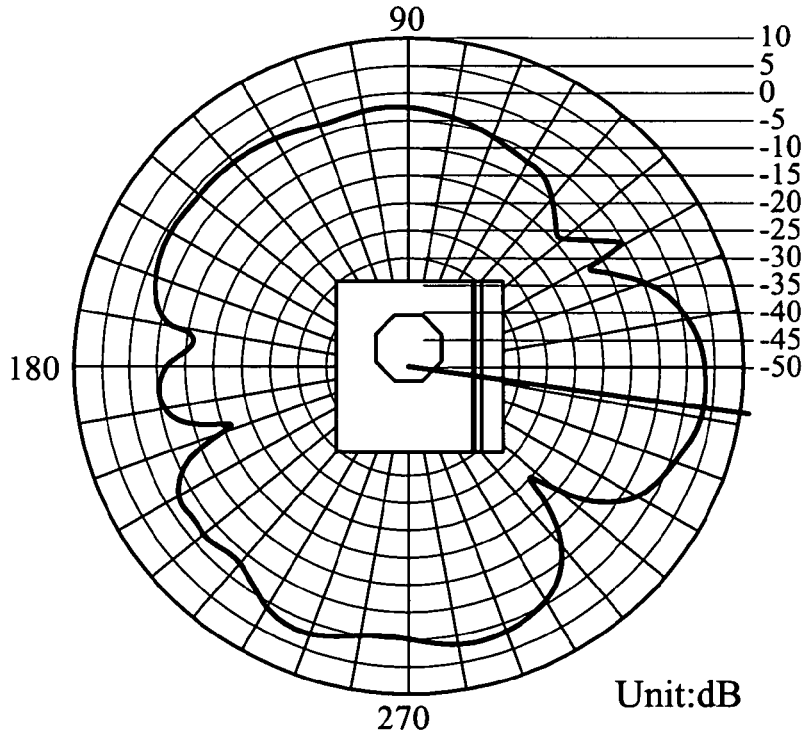
FIG. 11 is a chart showing the experimental measurement of the radiation field profile on the x-z plane when the dipole antenna according to the embodiment of the invention is applied to 2.4 GHz.
Figure 12:
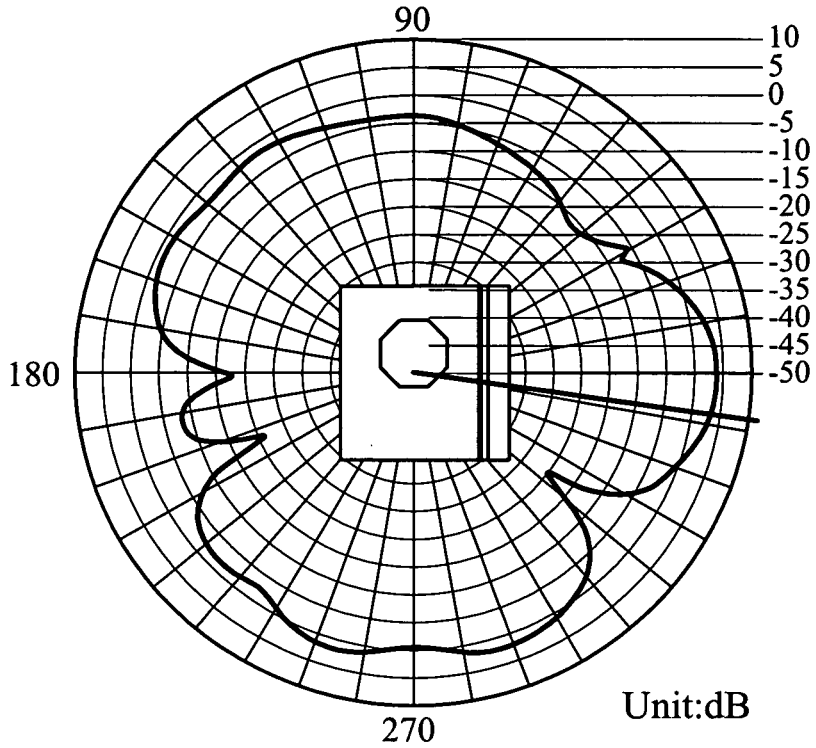
FIG. 12 is a chart showing the experimental measurement of the radiation field profile on the x-z plane when the dipole antenna according to the embodiment of the invention is applied to 2.45 GHz.
Figure 13:
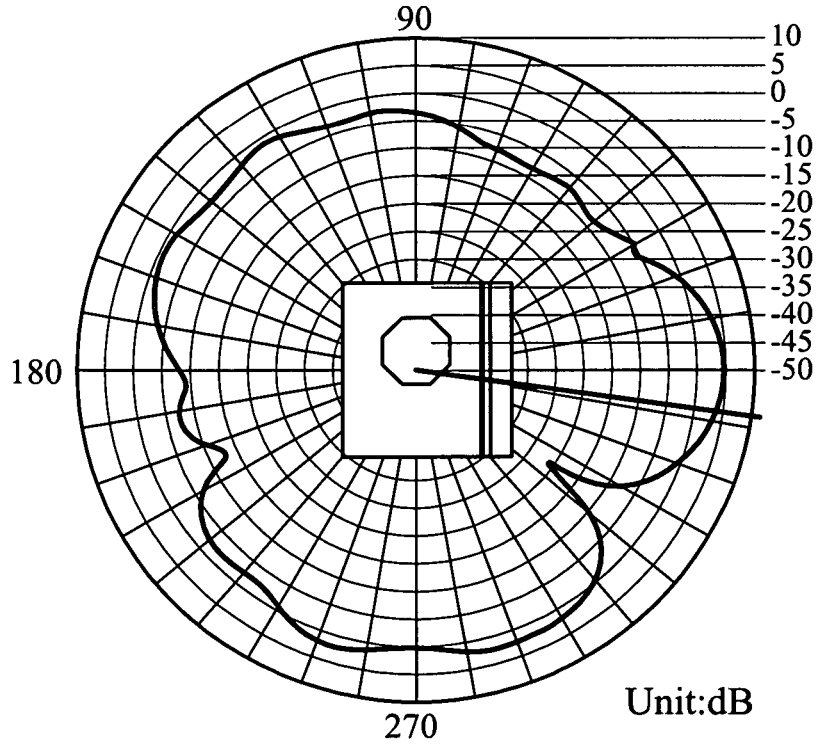
FIG. 13 is a chart showing the experimental measurement of the radiation field profile on the x-z plane when the dipole antenna according to the embodiment of the invention is applied to 2.5 GHz.

The test results of the invention based on the embodiment shown in FIG. 5 are depicted as follows, referring to FIGS. 6 through 13, including return loss, voltage stationary wave ratio and radiation field profiles. FIGS. 6 and 7 show the return loss and voltage stationary wave ratio in the frequency range of 2 GHz and 3 GHz. Then measurements of radiation field profiles on different planes are conducted at frequencies of 2.4 GHz, 2.45 GHz and 2.5 GHz. FIG. 8 shows the resulting radiation field profile on the x-y plane at a frequency of 2.4 GHz of an embodiment, which has a peak gain of 4.07 dBi. FIG. 9 shows the resulting radiation field profile on the x-y plane at a frequency of 2.45 GHz of an embodiment, which has a peak gain of 3.61 dBi. FIG. 10 shows the resulting radiation field profile on the x-y plane at a frequency of 2.5 GHz of an embodiment that has a peak gain of 3.74 dBi. FIG. 11 shows the resulting radiation field profile on the x-z plane at a frequency of 2.4 GHz of an embodiment that has a peak gain of 3.55 dBi. FIG. 12 shows the resulting radiation field profile on the x-z plane at a frequency of 4.22 GHz of an embodiment that has a peak gain of 3.61 dBi. FIG. 13 shows the resulting radiation field profile on the x-z plane at a frequency 2.5 GHz of an embodiment that has a peak gain of 4.26 dBi.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments, which do not depart from the spirit and scope of the invention.

What is claimed is:

1. A dipole antenna, comprising:

a radiation portion for receiving radio signals;

a first matching portion having a body section and a feed section, wherein one terminal of the body section connects to one terminal of the radiation portion, and another terminal connects to the feed section;

a second matching portion having one terminal connecting to another terminal of the radiation portion to cooperatively brace the radiation portion with the first matching portion;

a ground portion connecting to another terminal of the second matching portion; and an anchor section connecting to the ground portion to wedge in a device where the dipole antenna is mounted, wherein a direction of the anchor section forms an included angle with a direction of the ground portion.

2. The dipole antenna of claim 1, wherein the radiation portion, the first matching portion, the second matching portion and the ground portion are fabricated from a thin sheet of conductive metal.

3. The dipole antenna of claim 1, wherein the radiation portion, the first matching portion, the second matching portion and the ground portion are formed in an integrated manner.

4. The dipole antenna of claim 1, wherein the radiation portion, the first matching portion, the second matching portion, the ground portion and the anchor section are formed in an integrated manner.

5. The dipole antenna of claim 1, wherein the included angle is about 90 degrees.

6. The dipole antenna of claim 1, wherein the radiation portion has an electric length of a half of a wavelength.

7. The dipole antenna of claim 6, wherein the radiation portion is formed in a selected geometric shape.

8. The dipole antenna of claim 7, wherein the radiation portion is formed to be substantially rectangular.

9. The dipole antenna of claim 6, wherein the first matching portion and the second matching portion have an electric length of a quarter of a wavelength.

10. The dipole antenna of claim 9, wherein the first and second matching portions are formed in a selected geometric shape.

11. The dipole antenna of claim 10, wherein the first and second matching portions are formed in a meandering shape.

12. The dipole antenna of claim 1, wherein the feed section and the body section form an included angle.

13. The dipole antenna of claim 12, wherein the feed section is substantially parallel with the ground portion.

14. The dipole antenna of claim 13, wherein the feed section and the ground portion are spaced from each other at a determined distance to generate a capacitance effect, the determined distance being determined by the capacitance desired.

15. The dipole antenna of claim 14, wherein a region of the ground portion opposite to the feed section includes a notch that is substantially larger than the feed section for accommodating the feed section, so that the feed section and the ground portion are located on a same plane.

16. The dipole antenna of claim 14, further including a conductive wire having one terminal connecting to a juncture of the feed section and the body section and another terminal connecting to a transmission circuit of a device where the dipole antenna is mounted.

17. The dipole antenna of claim 16, wherein the conductive wire is a coaxial cable.

18. The dipole antenna of claim 17, wherein one terminal of the coaxial cable has an outer layer of a small section stripped, one terminal of which connects to the juncture and another terminal connects to the ground portion.

* * * * *